US009476580B2

(12) United States Patent
Treurniet et al.

(10) Patent No.: US 9,476,580 B2
(45) Date of Patent: Oct. 25, 2016

(54) LIGHTING DEVICE WITH SMOOTH OUTER APPEARANCE

(71) Applicant: KONINKLIJKE PHILIPS N.V., Eindhoven (NL)

(72) Inventors: Theodoor Cornelis Treurniet, Best (NL); Yan Xiong, Shanghai (CN); Simon Eme Kadijk, Veldhoven (NL); Howard Jiang, Shanghai (CN); Robert Zou, Shanghai (CN); Guangliang Guo, Shanghai (CN)

(73) Assignee: KONINKLIJKE PHILIPS ELECTRONICS N.V., Eindhoven (NL)

( * ) Notice: Subject to any disclaimer, the term of this patent is extended or adjusted under 35 U.S.C. 154(b) by 19 days.

(21) Appl. No.: 14/395,532

(22) PCT Filed: Apr. 16, 2013

(86) PCT No.: PCT/IB2013/052999

§ 371 (c)(1),
(2) Date: Oct. 20, 2014

(87) PCT Pub. No.: WO2013/156919

PCT Pub. Date: Oct. 24, 2013

(65) Prior Publication Data

US 2015/0062897 A1 Mar. 5, 2015

(30) Foreign Application Priority Data

Apr. 20, 2012 (WO) ..... PCT/CN2012/074472
May 21, 2012 (EP) ..... 12168673

(51) Int. Cl.

| | |
|---|---|
| ***F21V 29/00*** | (2015.01) |
| ***F21V 23/00*** | (2015.01) |
| ***F21V 7/00*** | (2006.01) |

(Continued)

(52) U.S. Cl.

CPC ..... *F21V 29/004* (2013.01); *F21K 9/137* (2013.01); *F21K 9/1375* (2013.01); *F21V 7/0066* (2013.01); *F21V 23/005* (2013.01); *F21V 29/2293* (2013.01); *F21V 29/83* (2015.01); *F21Y 2101/02* (2013.01)

(58) Field of Classification Search

CPC .. F21V 29/004; F21V 29/83; F21V 29/2293; F21V 7/0066; F21V 23/005; F21K 9/137; F21K 9/1375; F21Y 2101/02

See application file for complete search history.

(56) References Cited

U.S. PATENT DOCUMENTS

| | | | |
|---|---|---|---|
| 7,682,054 | B2 | 3/2010 | Hsu et al. |
| D645,579 | S | 9/2011 | Layevsky et al. |

(Continued)

FOREIGN PATENT DOCUMENTS

| | | | |
|---|---|---|---|
| WO | 2010066841 | A1 | 6/2010 |
| WO | 2011005314 | A1 | 1/2011 |

(Continued)

*Primary Examiner* — Alan Cariaso

(57) ABSTRACT

A lighting device or a lamp bulb (100, 200) with a smooth appearance comprises at least one light source (101); a heat sink component (104, 204), having a bottom (1043) and a side wall (1044) extending from the bottom (1044), wherein the bottom (1043) comprises a protrusion (1041) and wherein the at least one light source (101) thermally contacts the protrusion (1041) of the heat sink component (104, 204); and a cover provided on the sidewall (1044) opposite to the bottom (1043), thereby defining an air chamber (1051, 2051) between the cover, the side wall (1044), the bottom (1043) and the protrusion (1041).

15 Claims, 5 Drawing Sheets

(51) Int. Cl.

| | |
|---|---|
| ***F21K 99/00*** | (2016.01) |
| ***F21V 29/83*** | (2015.01) |
| *F21Y 101/02* | (2006.01) |

(56) References Cited

U.S. PATENT DOCUMENTS

| | | | | |
|---|---|---|---|---|
| 8,143,769 | B2 | 3/2012 | Li | |
| 8,164,237 | B2 * | 4/2012 | Wen | F21V 29/83 313/46 |
| 8,702,272 | B2 * | 4/2014 | Chuang | F21K 9/13 362/249.02 |
| 8,907,550 | B2 * | 12/2014 | Zaderej | F21K 9/00 313/46 |
| 2005/0111234 | A1 | 5/2005 | Martin et al. | |
| 2005/0174780 | A1 | 8/2005 | Park | |
| 2011/0037368 | A1 * | 2/2011 | Huang | F21V 29/02 313/46 |
| 2011/0050124 | A1 | 3/2011 | Bailey et al. | |
| 2011/0080096 | A1 | 4/2011 | Dudik et al. | |
| 2011/0090686 | A1 | 4/2011 | Pickard | |
| 2011/0140588 | A1 | 6/2011 | Chen | |
| 2011/0193463 | A1 | 8/2011 | Daniel | |
| 2012/0044680 | A1 | 2/2012 | Lin | |
| 2012/0161602 | A1 * | 6/2012 | Yu | F21K 9/135 313/46 |
| 2012/0300455 | A1 | 11/2012 | Breidenassel et al. | |

FOREIGN PATENT DOCUMENTS

| | | | |
|---|---|---|---|
| WO | 2011044274 | A1 | 4/2011 |
| WO | 2011089103 | A1 | 7/2011 |
| WO | 2011156210 | A1 | 12/2011 |

* cited by examiner

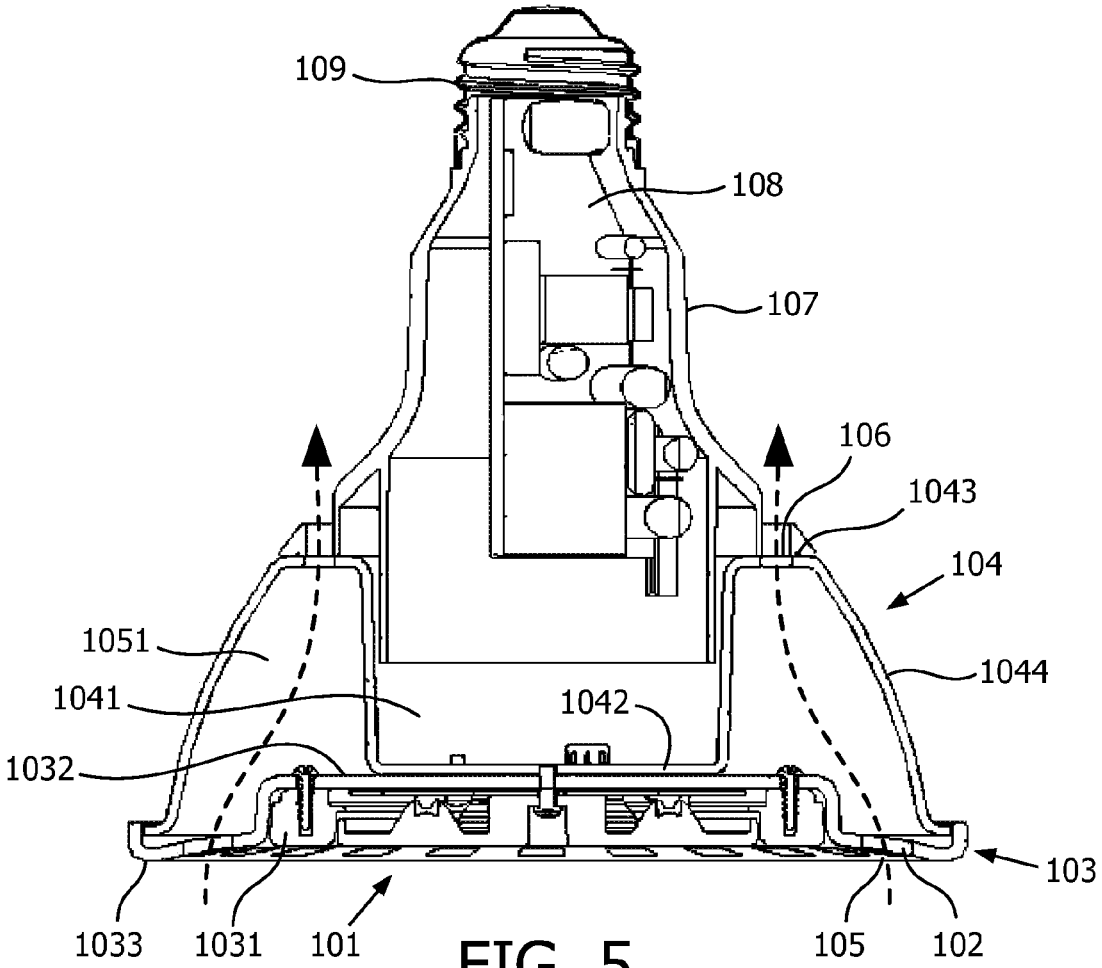
FIG. 5
FIG. 6
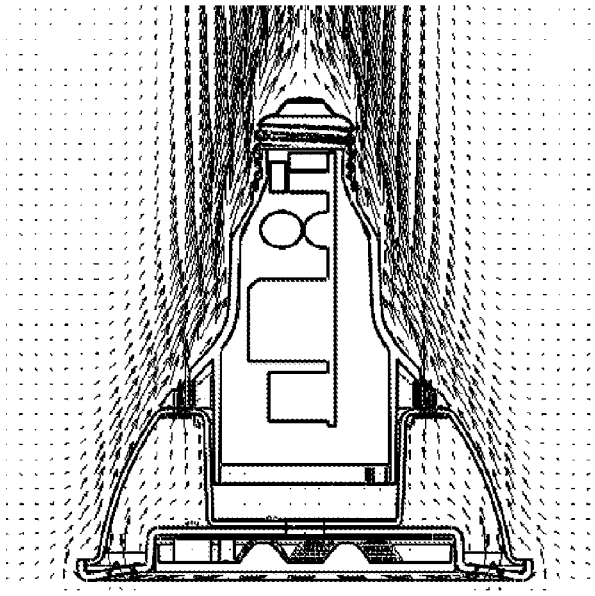

LIGHTING DEVICE WITH SMOOTH OUTER APPEARANCE

CROSS-REFERENCE TO PRIOR APPLICATIONS

This application is the U.S. National Phase application under 35 U.S.C. §371 of International Application No. PCT/IB2013/052999, filed on Apr. 16, 2013, which claims the benefit of Chinese Application PCT/CN2012/074472, filed Apr. 20, 2012 and European Patent Application No. 12168673.7, filed on May 21, 2012. These applications are hereby incorporated by reference herein.

FIELD OF THE INVENTION

The invention relates generally to a lighting device, and more specifically to a lighting device or a lamp bulb with a smooth outer appearance. The invention also relates to a luminaire with a lamp bulb having a smooth outer appearance.

BACKGROUND OF THE INVENTION

For an optimal thermal performance, a lighting device comprises a heat sink equipped with fins, for example back-reflecting lamp bulbs of type PAR, MR, BR, GU, etc. "PAR" means parabolic aluminized reflector. "MR" means multifaceted reflector. "BR" means bulged reflector, and "GU" refers to a U-shaped lamp with a plug-in lamp base. The light sources of the lamps include conventional halogen filaments or LED light sources.

Conventional heat sinks are made of die casting metal, such as aluminum, with high manufacturing and raw material costs. Further, for aesthetic reasons, a non-technical appearance without a visible cooling structure is desired. If the heat sink structure is hidden behind a smooth outer surface, airflow through the cooling structure is preferred for improved thermal performance, which requires inlet and outlet openings. For the desired look-and-feel, these openings should be small. However, a small channel has a high airflow resistance, reducing the cooling performance of the heat sink structure. Since the cooling performance is mainly determined by the amount of air that flows through the cooling structure, also referred to as internal channel, this will reduce the cooling performance of the heat sink.

US2012/0044680A1 discloses an illustrator with LED including a rear housing having a cavity. A front housing is disposed in the cavity, wherein the front housing includes through holes. An illuminating module is sandwiched between the rear housing and the front housing. Air holes are formed on the side wall of the rear housing, so that the cavity can communicate with outside air.

It is desired to combine optimal heat dissipation with the advantages of a smooth outer appearance of the lighting device.

SUMMARY OF THE INVENTION

It is an object of the invention, among others, to achieve a lighting device with a smooth appearance and with the advantages of low cost, good manufacturability and high heat dissipation capability.

To better address one or more of these concerns, in an aspect of the invention, an embodiment of a lighting device is presented, comprising: at least one light source; a heat sink component, having a bottom and a side wall extending from the bottom, wherein the bottom comprises a protrusion, and wherein the at least one light source thermally contacts the protrusion of the heat sink component; and a cover provided on the sidewall opposite to the bottom, thereby defining an air chamber between the cover, the side wall, the bottom and the protrusion. The protrusion provides an increased surface area of the heat sink component, leading to improved thermal properties of the heat sink and furthermore it provides a part of the enclosure of the air chamber. In another embodiment, the width or diameter of the protrusion is the same as the width or diameter of the bottom, and hence the air chamber is enclosed by the protrusion, the side wall and the cover, because in this case the total area of the bottom is the protrusion. Thus, in this case the side wall effectively extends from the protrusion.

Preferably, the cover is of a thermally conductive material which thermally contacts the side wall of the heat sink component. In a further embodiment, the cover comprises a recess which accommodates the at least one light source, and the recess thermally contacts the protrusion. In this way an additional thermal contact between the at least one light source and the heat sink component is provided in a convenient and simple way. Further, a part of the cover may comprise a light exit window which may comprise an optical element, such as diffuser, a lens, etc.

Preferably, the protrusion has a side surface and a top surface, and the side surface forms a portion of the air chamber. Thus, the top surface of the protrusion does not form a portion of the air chamber. In this embodiment, the side surface of the protrusion is part of the enclosure of the air chamber, together with the side walls of the heat component, the cover and a part of the bottom. In the case that the whole bottom area is a protrusion, the air chamber is defined and enclosed by the side surface of the protrusion, the side wall of the heat sink component and the cover.

Preferably, the cover comprises a first opening, the heat sink component comprises a second opening, and the air chamber forms a channel between the first opening and the second opening to allow a flow of air between the first and second opening or vice versa. This provides for additional cooling and a further improved heat sink capacity of the heat sink component. The protrusion provides an increased air flow cooling area of the heat sink component with respect to the state of the art in which no protrusion is defined. Preferably, a cross section of the channel is larger than at least one of the first opening and the second opening. By enlarging the cross section of the air chamber or channel between the inlet and the outlet, so that the air velocity inside the air chamber or channel is as low as possible, flow losses in the system are minimized.

In an embodiment, the bottom of the heat sink component is substantially circular and the protrusion is also substantially circular. In this case, the side wall also will have a substantially circular cross-section and also the cover will be substantially circular.

In an embodiment, the protrusion encompasses at least a part of an electronic component. The electronic component drives the at least one light source. In this way, space is saved by using the protrusion to enclose at least a part of the electronic component. In this embodiment, the electronic component thus is not part of the air chamber but is situated outside the air chamber in another chamber between the protrusion of the heat sink component and a base of a lamp which comprises the lighting device. Preferably, electrical contacts are provided between the electronic component and the at least one light source via through holes in the heat sink component.

There is a larger area for thermal coupling by virtue of the protrusion and therefore improved thermal performance of the lighting device. In an embodiment, the cover is additionally mechanically attached to the protrusion, next to the mechanical attachment (and thermal connection) to the side wall of the heat sink component. Furthermore, the air can flow alongside the protrusion, which further improves the thermal performance of the lighting device.

Preferably, the side wall of the heat sink component has the shape of the side walls of a cup.

The heat sink component and optionally also the cover can be made of sheet metal, such as aluminum plates, using a low-cost metal stretching process, such as deep drawing. Alternatively, the heat sink component and optionally also the cover can be made of plastic, using a stretching or injection/molding process. Compared to the conventional heavy die-cast heat sink, the cost of both raw material and manufacturing can be decreased, and the weight of the final product can be reduced.

According to an embodiment of the lighting device, the cover comprises a rim at its outer periphery, and the first opening comprises a plurality of holes near the rim. Advantageously, the rim provides a mechanical attachment to the side wall.

According to another embodiment of the lighting device, the heat sink component comprises a first and a second opening, and the air chamber forms a channel between the first opening and the second opening to allow a flow of air between the first and second opening or vice versa, and wherein the first opening is a slit in the side wall of the heat sink component.

The first opening is thus designed as holes in the cover or a hardly visible narrow slit in the side wall, resulting in an unobtrusive opening in the main view of the lighting device in the form of a lamp bulb. This may provide an ornamental effect to the bulb.

According to a further embodiment of the lighting device, the second opening of the lighting device preferably comprises a plurality of holes in the bottom of the heat sink component between the protrusion and the side wall of the heat sink component. This provides an unobtrusive, hardly visible opening in the main view of the lighting device in the form of a lamp bulb with an ornamental effect.

Preferably, the side wall of the heat sink component has an intact smooth exposed surface, without holes, slots or fins, which provides an ornamental effect in the main view of the lighting device in the form of a lamp bulb. The exposed surface has a relatively good heat dissipation capacity.

According to yet another embodiment of the lighting device, the second opening comprises a plurality of holes disposed in the side wall of the heat sink component adjacent to the bottom of the heat sink component.

Preferably, the heat sink component and the cover are thermally coupled at least through engagement between a bottom portion of a recess in the cover and a top surface portion of the protrusion of the heat sink component. The heat generated by the light source and/or the electronic driving component can be conducted via the heat sink component and the cover and transported to the surrounding air via the exposed surfaces.

In a further embodiment, the at least one light source is thermally coupled to a PCB. The PCB extends into the air chamber, and the PCB has a plurality of PCB openings to allow the flow of air between the first and second opening or vice versa. The PCB openings may be cut-outs at the edge of the PCB or holes in the PCB. Preferably, the PCB comprises a thermally conductive material, for example, a thick layer of copper, so that thermal conductivity of the PCB is at least 28 W/mK measuring along surface of the PCB.

This provides the PCB with good thermal conductivity, and therefore the PCB itself can act as a good heat sink. In other words, the air flow can dissipate the heat from the light source via the PCB. In one aspect, this brings additional thermal performance to the lighting device. In another aspect, this lowers the thermal requirements to all other components in the lighting device, for example, the shell (or call heat sink component as above) and the cover can be made of full plastic. Thus, the design of the lighting device is eased. It may not need glue, or grease, for the thermal coupling between components. As a full plastic lamp, painting may no longer be needed, and there may be much less safety concerns of electric shock due to metal housing. The process of assembly of the lighting device may also be simplified. By this way, the total cost of the lighting device is greatly decreased.

In other embodiments of the lighting device, the recess of the cover can further comprise a reflector. In yet other embodiments of the lighting device, the at least one light source comprises a LED or an array of LEDs, and the lighting device can be a back-reflecting lamp bulb of type GU, MR, BR or PAR, such as GU10, MR16, BR30, BR40, R20, PAR38, PAR30L, PAR30S, PAR20, etc.

According to second aspect of the invention, a luminaire is provided which comprises a lighting device or lamp bulb according to the first aspect of the invention with a smooth outer appearance.

It is noted that the invention relates to all possible combinations of features recited in the claims.

BRIEF DESCRIPTION OF THE DRAWINGS

These and other aspects of the lighting device and luminaire according to the invention will become apparent from and will be elucidated with respect to the implementations and embodiments described hereinafter and with reference to the accompanying drawings. In the drawings:

FIG. 5 shows a schematic sectional side view of the lighting device illustrated in FIG. 1;

FIG. 6 illustrates the air velocity around and within the lighting device illustrated in FIG. 1 during operation;

DETAILED DESCRIPTION

Figure 1:
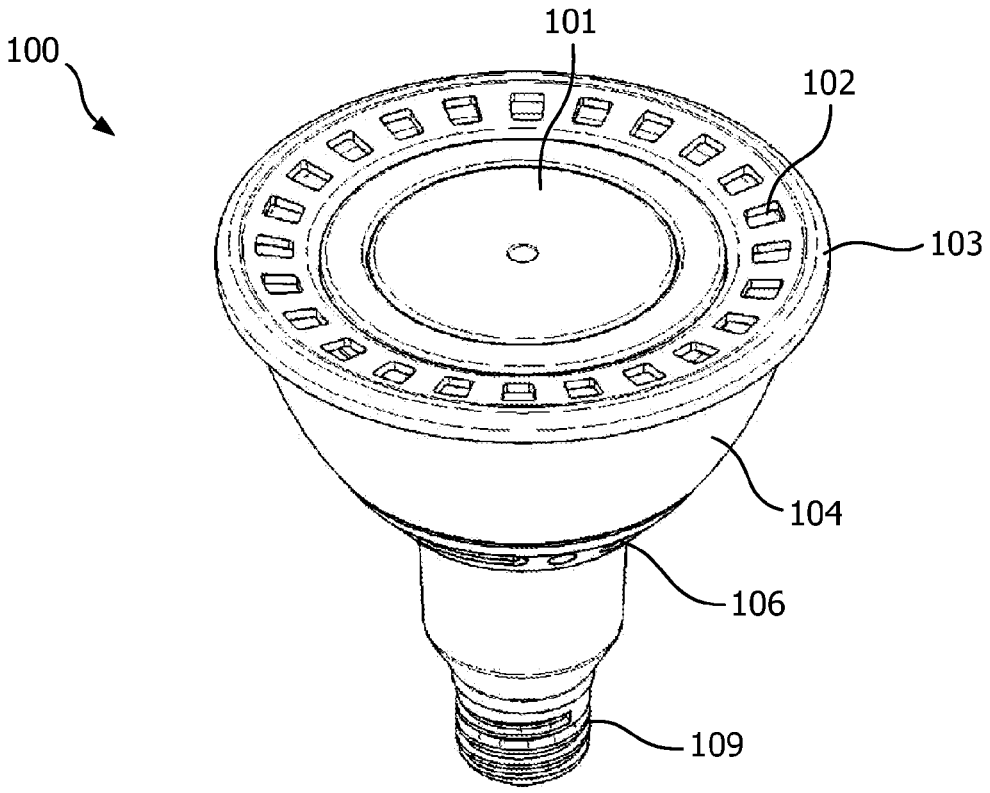
FIG. 1 shows a lighting device according to an embodiment of the invention.

An embodiment of the lighting device according to the present inventive concept is illustrated in FIG. 1, and different views of the lighting device are presented in FIGS. 2 to 5. FIG. 1 shows a PAR lamp 100 with LEDs or a LED array representing a light source 101 mounted in the front end opposite to the base 109. The light source 101 is thermally coupled to a cover 103 and a heat sink component 104. There are holes 102 in the cover 103, and holes 106 in the heat sink component 104. The cover 103 may act as an additional heat sink component and is thermally coupled to the heat sink component 104 at least along its outer periphery.

As shown in FIG. 5, the cover 103 has a recess 1031 for accommodating the light source 101. Alternatively, the light source 101 is provided on the heat sink component 104, for example on the bottom part of the recess 1031, and the cover 103 comprises a light exit window where the light from the light source 101 can exit. The heat sink component 104 is, in this case, cup-shaped, and has a side wall 1044 and a bottom 1043 with a protrusion 1041 provided in the bottom 1043 of the heat sink component 104. The protrusion 1041 is adapted for receiving and partly enclosing an electronic driving component 108 which is adapted to provide energy to the light source 101. Furthermore, a housing 107 is provided between the heat sink component 104 and the base 109. The housing 107 can be made of plastic and provides a safety shield for the electronic driving component 108.

The cover 103 and the heat sink component 104 are, in this case, assembled with a good thermal connection at the recess bottom 1032 and the protrusion top surface 1042, in addition to the thermal contact between the side wall of the heat sink component 104 and the outer periphery of the cover 103. The heat generated by the light source 101 will, in this case, be conducted to the heat sink component 104 and the cover 103, in this case also acting as a heat sink, and will be dissipated relatively well at the exposed surfaces of the heat sink component 104 and the cover 103. The thermal connection between the recessed bottom 1032 and the protrusion top surface 1042 can be established via direct attachment or via a thermally conducting medium, such as thermal glue or thermal filler. The thermal connection thickens the base of the heat sink and results in a better temperature distribution under the heat source.

Figure 2:
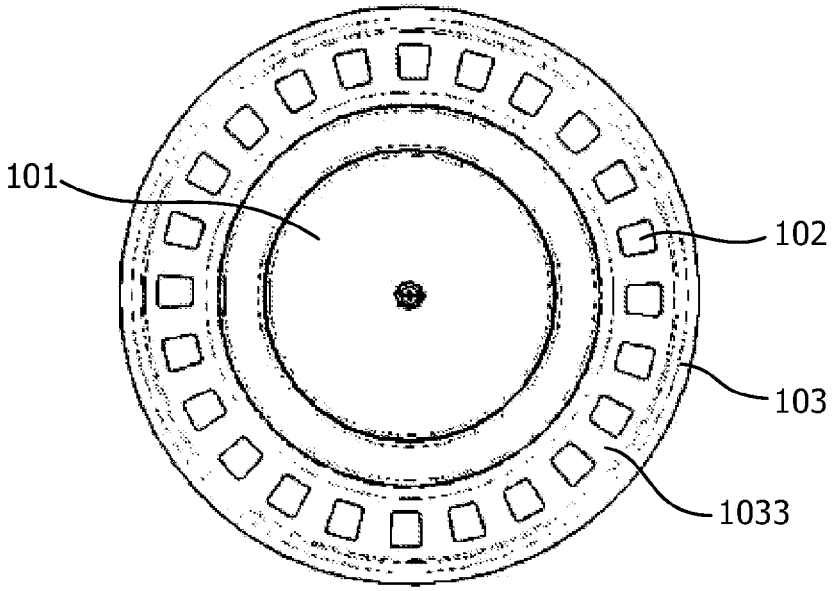
FIG. 2 shows a top view of the lighting device illustrated in FIG. 1.
Figure 3:
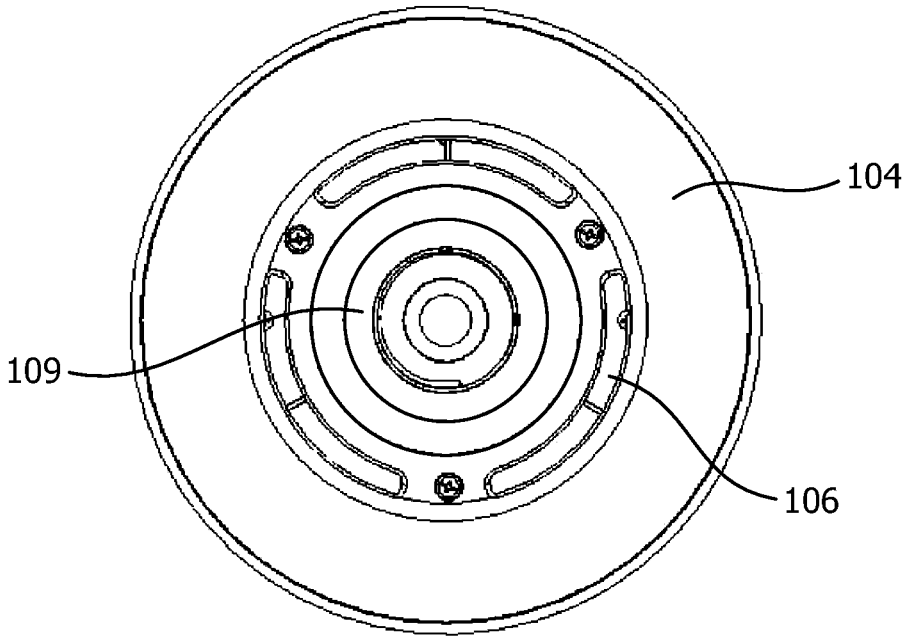
FIG. 3 shows a bottom view of the lighting device illustrated in FIG. 1.

An air chamber 1051 is formed between the cover 103 and the heat sink component 104. As shown in FIG. 2, first holes 102 are provided in a rim 1033 around the recess 1031 of the cover 103, thereby creating a first connection between the air chamber 1051 and ambient air. Furthermore, second holes 106 are provided in the bottom 1043 of the heat sink component 104 adjacent to the side wall 1044, thereby creating a second connection between the air chamber 1051 and ambient air. First and second holes 102 and 106, together with the air chamber 1051, form a channel allowing air to flow through the air chamber 1051, as the dash-lined arrow 105 indicates. When the lamp 100 is operated as is illustrated in FIG. 5, in this case a down-lighting, a chimney effect will be created in the heat sink structure, as is illustrated in FIG. 6 which shows the air flow inside and outside the lamp 100, wherein the arrows indicate the direction (direction of arrow) and the speed (size of arrow) of the airflow. The heat source, i.e. the light source 101, pre-heats the airflow and creates a buoyancy force. The higher the temperature of the air becomes, the larger the driving force will be. This driving force is created by the density difference between hot air and the relatively cold ambient air. In a gravitational field, the hot air becomes less dense and rises, driven by the buoyancy force. Meanwhile, the cold air follows, taking up the space left by hot air, thus creating the airflow. When the air passes through the channel, it has been and will be heated and thus stores a certain amount of energy. As long as the air leaves the channel or air chamber, the heat is transported away. The heat produced by LEDs is mainly removed through the moving air, including both internal (in the chimney channel or air chamber) and external moving air, i.e. outside the lighting device.

At the same time, radiation heat transfer is also a significant source for dissipating the generated heat in addition to natural convection. Both the rim 1033 of the cover 103 and the side wall 1044 of the cup-shaped heat sink component 104 are exposed to ambient air, and allow radiation heat transfer.

The air flow direction 105 is upwards in FIG. 5. However, a person skilled in the art can understand that the air flow direction 105 can be reversed in situations where the lamp 100 operates in another direction. The chimney effect can be built up within the air chamber 1051 of the heat sink component because of a temperature gradient, and will force the air to flow through the air chamber 1051.

In this embodiment, the cross section of the channel between the inlet, i.e. first or second holes 105,106, and outlet, i.e. second or first holes 106, 105, is enlarged, so that the air velocity inside the air chamber 1051 is as low as possible and the overall flow losses in the system are minimized. This is advantageous because it decreases the thermal resistance.

Figure 4:
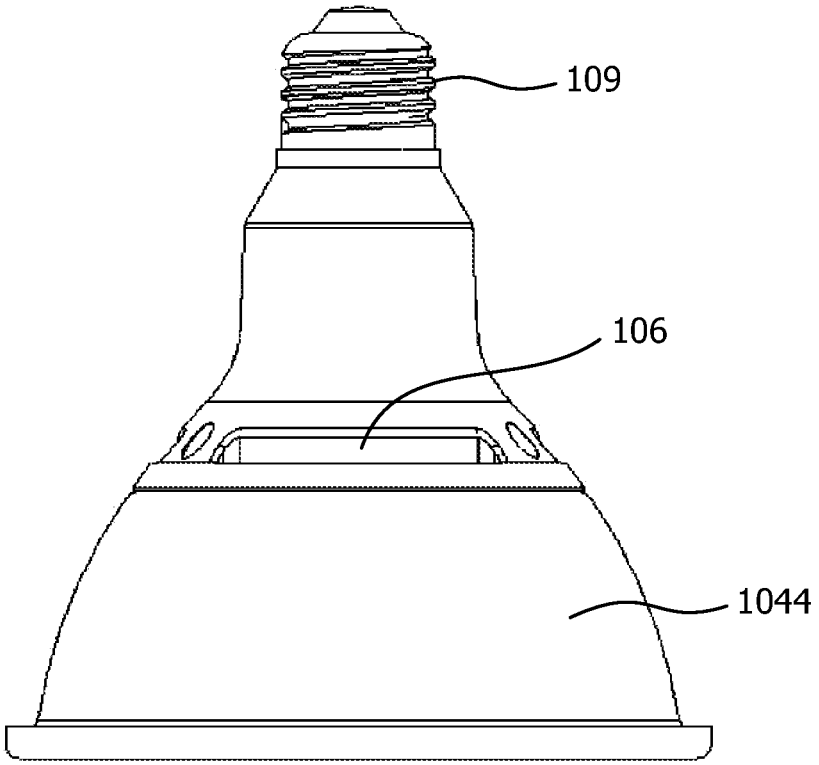
FIG. 4 shows a side view of the lighting device illustrated in FIG. 1.

As is shown in FIG. 4, which is an outside view of the lamp 100, the side wall 1044 of the heat sink component 104 is an intact smooth exposed surface, without holes, slots or fins, which provides an ornamental effect. Comparing to the construction of the prior art lamp foot, e.g., in US2012/0044680A1, which is not possible to have holes in the bottom, the cooling effect of the lamp 100 is improved further, because the cooling is implemented by extending the path for the air to flow and this is done by moving the holes to the bottom of the heat sink. As shown in FIG. 4, a part of the bottom 1043 of the heat sink is not covered by the housing 107, to allow air flow through the holes.

Figure 7:
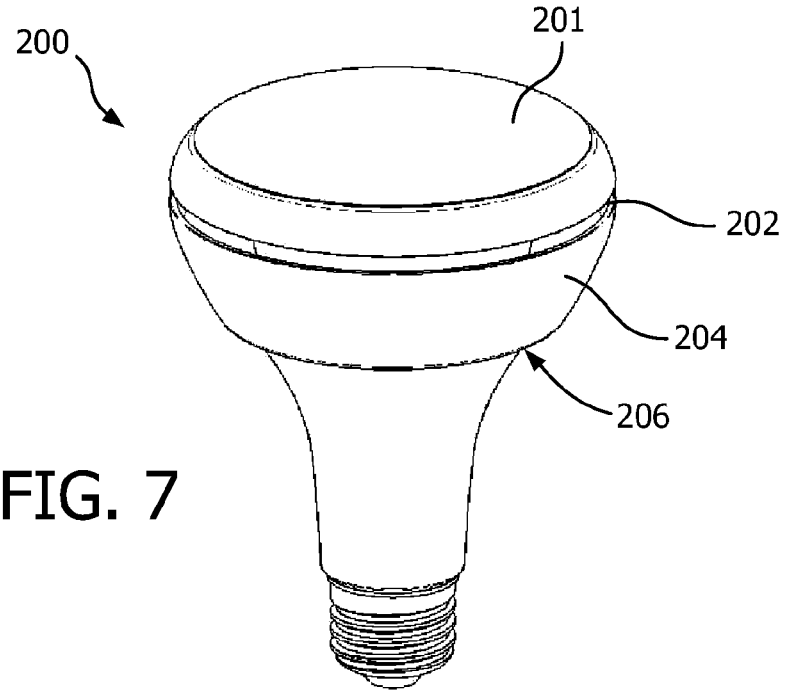
FIG. 7 shows a lighting device according to another embodiment of the invention.
Figure 8:
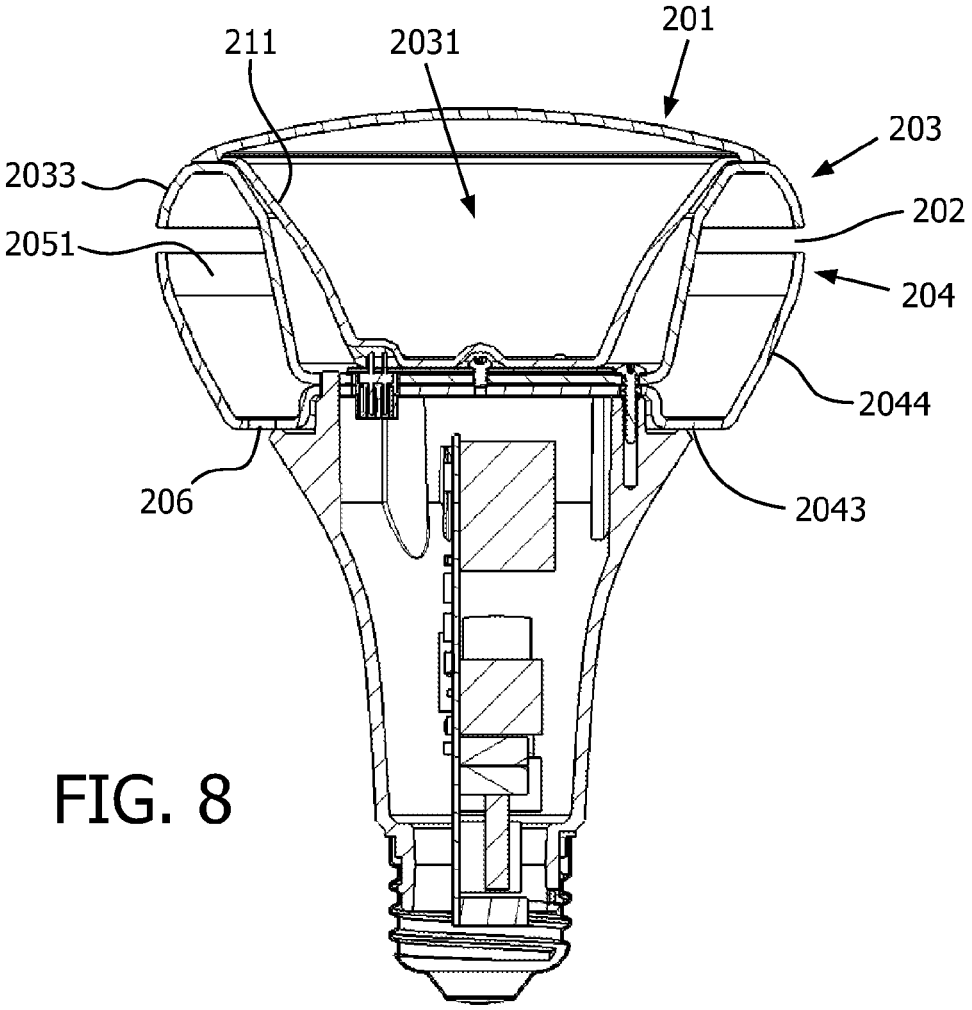
FIG. 8 shows a schematic sectional side view of the lighting device illustrated in FIG. 7.

FIG. 7 and FIG. 8 show another embodiment of the invention, wherein a BR lamp 200 has a narrow slit 202 in side wall 2044 of heat sink component 204 adjacent or near to a rim 2033 of a cover 203 instead of the first holes 102 in the cover 103 in the first embodiment. The narrow slit 202 is hardly visible, while, also in this embodiment, the internal structure (air chamber 2051) is much wider. Second holes 206 are provided in the bottom 2043 of the cup-shaped heat sink component 204. Also in this embodiment, the side wall 2044 is an intact smooth exposed surface, without holes, slots or fins, which provides an ornamental effect. In addition, a reflector 211 is included in the recess 2031 of the cover 203 providing a desired optical performance of the lamp 200.

The protrusion of the heat sink component 204 is relatively small in height compared to the height of the protrusion of the heat sink component 104 of the first embodiment. And, therefore, in this case the electronic driving component is accommodated in the housing. The airflow within air chamber 2051 formed between the cover 203 and the heat sink component 204 provides an optimal thermal performance.

Figure 9:
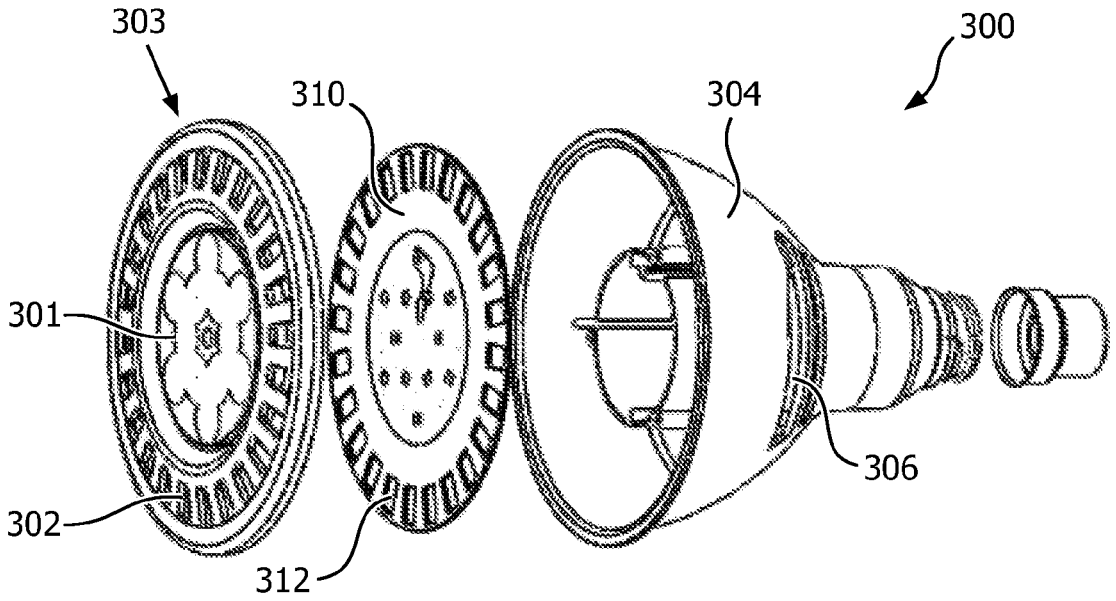
FIG. 9 shows an explosive view of a lighting device according to a further embodiment of the invention.
Figure 10:
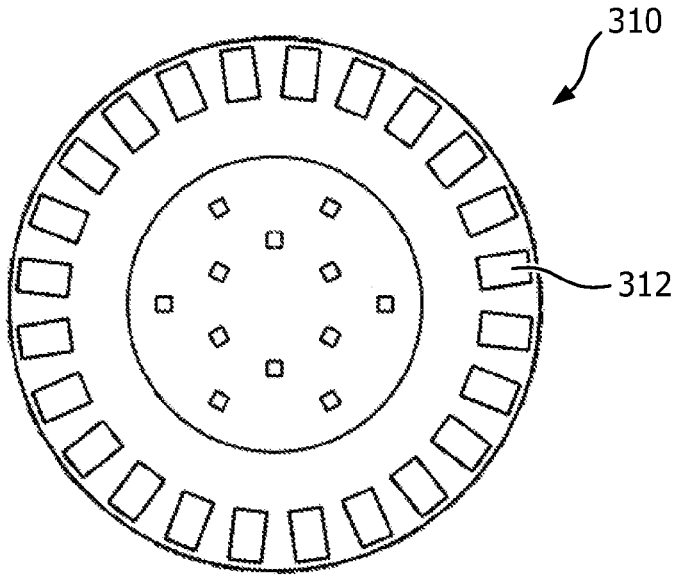
FIG. 10 shows the PCB of the lighting device in FIG. 9.

In a further embodiment of the invention as shown in FIG. 9, the light source 301 is thermally coupled to a big Print Circuit Board (PCB) 310. The PCB 310 extends into the air chamber, and the PCB has a plurality of PCB openings to allow the air flow goes fluently between the first opening 302 of the cover 303 and second opening 306 of the shell 304. The PCB openings may be cut-outs at the edge of the PCB or holes 312 as shown in FIG. 10. Preferably, the holes 312 are aligned with the holes 302 in the cover 303 so as to allow maximum air flow. The PCB 310 comprises a thermally conductive material, for example, a thick layer of copper, so that thermal conductivity of the PCB is at least 28 W/mK measuring along surface of the PCB. In this embodiment, the PCB 310 acts as a heat sink which can bring additional thermal performance to the lamp 300 or provide solutions with lower cost.

A person skilled in the art can understand that other types of back-reflecting lamp bulbs, such as GU, MR, etc., can adopt the same principle to achieve a lamp with a smooth appearance and the advantages of low cost, good manufacturability and high heat dissipation capability.

A person skilled in the art realizes that the present invention by no means is limited to the preferred embodiments described above. On the contrary, many modifications and variations are possible within the scope of the appended claims. It should be noted that the above-mentioned embodiments illustrate rather than limit the invention and that those skilled in the art will be able to design alternative embodiments without departing from the scope of the appended claims. In the claims, any reference signs placed between parentheses shall not be constructed as limiting the claim. The word "comprising" does not exclude the presence of elements or steps not listed in a claim. The word "a" or "an" preceding an element does not exclude the presence of a plurality of such elements. The usage of the words first, second and third, etc., does not indicate any ordering. These words are to be interpreted as names. No specific sequence of acts is intended to be required unless specifically indicated.

The invention claimed is:

1. A lighting device comprising:

at least one light source;

a heat sink component having a bottom and a side wall extending from the bottom, wherein the bottom comprises a protrusion and wherein the at least one light source thermally contacts the protrusion of the heat sink component; and a cover provided on the side wall and opposite to the bottom, thereby defining an air chamber between the cover, the side wall, the bottom and the protrusion, wherein the heat sink component comprises a second opening, and the second opening comprises a plurality of holes in the bottom of the heat sink component that are disposed below the protrusion between the protrusion and the side wall of the heat sink component.

2. The lighting device according to claim 1, wherein the cover is of a thermally conductive material which thermally contacts the side wall of the heat sink component.

3. The lighting device according to claim 2, wherein the cover comprises a recess which accommodates the at least one light source.

4. The lighting device according to claim 3, wherein the recess thermally contacts the protrusion.

5. The lighting device according to claim 1, wherein the protrusion has a side surface and a top surface, and wherein the side surface, not the top surface, of the protrusion forms a portion of the air chamber.

6. The lighting device according to claim 1, wherein the cover comprises a first opening, and the air chamber forms a channel between the first opening and the second opening to allow a flow of air between the first and the second opening or vice versa.

7. The lighting device according to claim 6, wherein a cross section of the channel is larger than at least one of the first opening and the second opening.

8. The lighting device according to claim 6, wherein the cover comprises a rim at its outer periphery, and the first opening comprises a plurality of holes near the rim.

9. The lighting device according to claim 1, wherein the heat sink component comprises a first opening, and the air chamber forms a channel between the first opening and the second opening to allow a flow of air between the first and second opening or vice versa, and wherein the first opening is a slit in the side wall of the heat sink component.

10. The lighting device according to claim 6, wherein the at least one light source is thermally coupled to a printed circuit board (PCB), which wherein the PCB extends into the air chamber and wherein the PCB has a plurality of PCB openings to allow the flow of air between the first and second opening or vice versa.

11. The lighting device according to claim 10, wherein the PCB comprises a thermally conductive material so that thermal conductivity of the PCB is at least 28 W/mK along a surface of the PCB.

12. The lighting device according to claim 1, wherein the side wall has an intact smooth exposed surface.

13. The lighting device according to claim 3, wherein the recess further comprises a reflector.

14. The lighting device according to claim 1, wherein the protrusion encompasses at least a part of an electronic component.

15. A luminaire comprising a lighting device according to claim 1.

* * * * *